US005371799A

United States Patent [19]

Lowe et al.

[11] Patent Number: 5,371,799

[45] Date of Patent: Dec. 6, 1994

[54] STEREO HEADPHONE SOUND SOURCE LOCALIZATION SYSTEM

[75] Inventors: Danny D. Lowe; Terry Cashion; Simon Williams, all of Calgary, Canada

[73] Assignee: QSound Labs, Inc., Calgary, Canada

[21] Appl. No.: 69,870

[22] Filed: Jun. 1, 1993

[51] Int. Cl.[5] ..... H04R 25/00

[52] U.S. Cl. ..... 381/25; 381/17; 381/63

[58] Field of Search ..... 381/25, 17, 63, 18, 381/24, 26

[56] References Cited

U.S. PATENT DOCUMENTS 5,173,944 12/1992 Begault ..... 381/17

5,187,692 2/1993 Haneda et al. ..... 367/135

*Primary Examiner*—Curtis Kuntz

*Assistant Examiner*—Huyen D. Le

*Attorney, Agent, or Firm*—Jay H. Maioli

[57] ABSTRACT

A system for processing an audio signal for playback over headphones in which the apparent sound source is located outside of the head of the listener processes the input signal as if it were made up of a direct wave portion, an early reflections portion, and a reverberations portion. The direct wave portion of the signal is processed in filters whose filter coefficients are chosen based upon the desired azimuth of the virtual sound source location. The early reflection portion is passed through a bank of filters connected in parallel whose coefficients are chosen based on each reflection azimuth. The outputs of these filters are passed through scalars to adjust the amplitude to simulate a desired range of the virtual sound source. The reverberation portion is processed without any sound source location information, using a random number generator, for example, and the output is attenuated in an exponential attenuator to be faded out. The outputs of the scalars and attenuators are then all summed to produce left and right headphone signals for playback over the respective headphone transducers.

8 Claims, 8 Drawing Sheets

FIG.6A
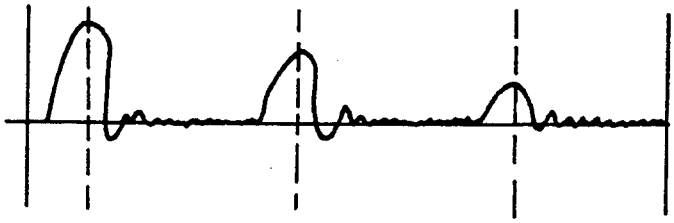
FIG.6B
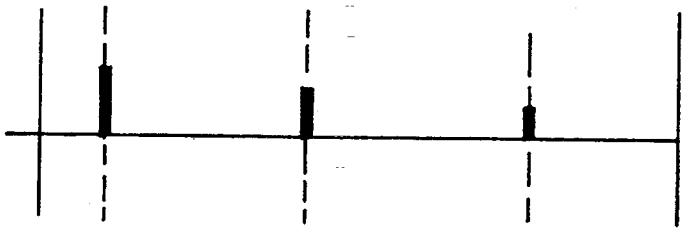
FIG.6C
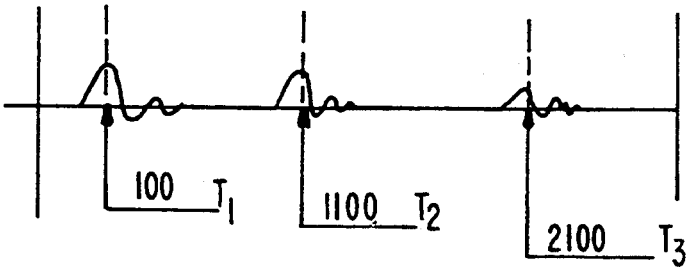
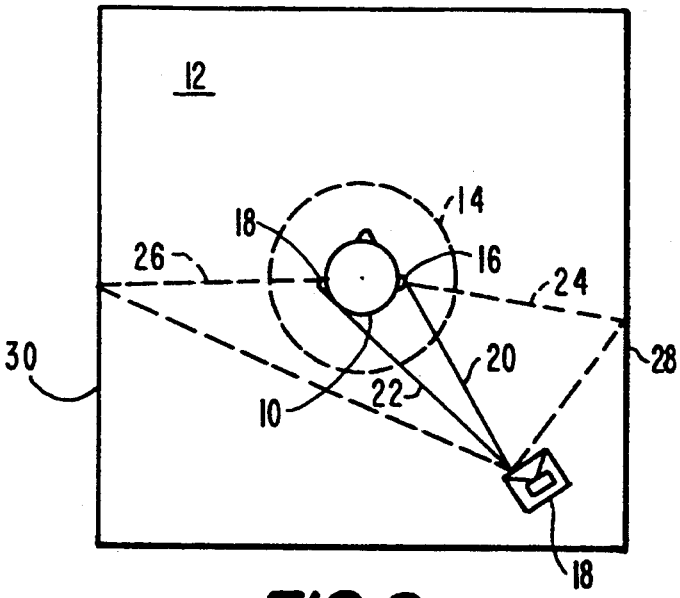
FIG. 2

| | ANGLE | AMPLITUDE | DELAY (μs.) |
|---|---|---|---|
| 1. | +90° | -3db | 600 |
| 2. | +45° | -1.5db | 300 |
| 3. | 0° | - 0.0 | 0 |
| 4. | -45° | -1.5db | 300 |
| 5. | -90° | -3db | 600 |

STEREO HEADPHONE SOUND SOURCE LOCALIZATION SYSTEM

BACKGROUND OF THE INVENTION

1. Field of the Invention

This invention relates generally to sound image processing for reproducing audio signals over headphones and, more particularly, to apparatus for causing the sounds reproduced over the headphones to appear to the listener to be emanating from a source outside of the listener's head and also to permit such apparent sound location to be changed in position.

2. Description of the Background

In view of the generally crowded nature of modern society, headphones and small earphones have been becoming more and more popular in providing personal musical entertainment. In addition, headphones are frequently used when playing video games when other are in the room. Although many headphones provide very good fidelity in reproducing the original sounds and also provide generally good stereo effects, such stereo effects really are based on sounds being either directly at the left ear or the right ear. In balanced signals, such as a monaural signal, where the signal at each ear is approximately the same, the sound will appear to the listener to be originating from a source at the center of his head. This is not considered a generally pleasant experience and is fatiguing to the listener after a short period of time.

This in-the-head sound placement is not present when reproducing sounds using loudspeakers placed in front of the listener such as found in a conventional stereo system. Moreover, the sound locations are presently being spread around the entire room in the so-called surround-sound systems. In these kinds of loudspeaker installations, good stereo imaging can be readily accomplished. Not only is good stereo imaging generally available with a pair of loudspeakers, but recent advances in digital signal processors have permitted digital filtering to be applied to audio signals to selectively position the apparent sound origins even outside of the fixed locations of the two stereo speakers. In other words, transfer functions are available to selectively locate a sound origin and by sequentially selecting such transfer functions it is possible to create virtual sound image locations that appear to move relative to the stationary listener.

Even though such systems are apparently made possible due to the human physiology, applying the same transfer functions used in the loudspeaker application to headphones has not resulted in acceptable results. Moving locations are not possible except the extremes from the left ear to the right ear, or vice versa, and more times than not the sound image still remains inside the listener's head. Quite probably this non-correlation between headphones and loudspeakers is due to the manner in which the human brain interprets the different times of arrival and different amplitudes of audio signals at the respective ears of the listener.

Therefore, a system that can provide an apparent or virtual sound location out of the headphone user's head is highly desirable and, moreover, a system in which the apparent sound source could be made to move, preferably at the instigation of the user, would also be highly desirable.

OBJECTS AND SUMMARY OF THE INVENTION

Accordingly, it is an object of the present invention to provide an apparatus for processing audio signals for playback over headphones in which the sounds appear to the listener to be emanating from a source located outside of the listener's head at a location in the space surrounding that listener.

It is another object of this invention to provide apparatus for reproducing audio signals over headphones in which the apparent location of the source of the audio signals is located outside of the listener's head and in which that apparent location can be made to move in relation to the listener.

It is a further object of this invention to provide apparatus for causing an apparent location of the source of audio signals to exist outside of the head of the headphone user and in which the user can cause the apparent location of the audio signals to move by operation of a device, such as a joystick.

In accordance with an aspect of the present invention, an audio sound signal is processed to produce two signals for playback over the left and right transducers of a headphone, and in which the single input signal is provided with directional information so that the apparent source of the signal is located someplace on a circle surrounding the outside of the listener's head.

Another aspect of the present invention involves providing signal processing filters that are specifically selected to deal with different portions of a signal waveform as it might be present at an ear of a listener seated inside a typical room environment. By determining that such signals present in a room can be treated as separate portions, each portion is then processed in accordance with its own peculiarities in order to reduce the hardware requirement in the overall signal processing system. In addition, by recognizing the specific inherent features of the various portions of the reflected signal, it is possible to provide filtering using less extensive digital filters and thereby provide further hardware savings.

The above and other objects, features, and advantages of the present invention will become apparent from the following detailed description of illustrative embodiments thereof, to be read in conjunction with the accompanying drawings in which like reference numerals represent the same or similar elements.

BRIEF DESCRIPTION OF THE DRAWINGS

FIG. 2 is a diagrammatic representation of a listener in the room receiving the room impulse from the loudspeaker;

FIGS. 6A–6C represent examples of filter reflections relative to a sound wave according to an embodiment of the present invention;

DETAILED DESCRIPTION OF PREFERRED EMBODIMENTS

Figure 1:
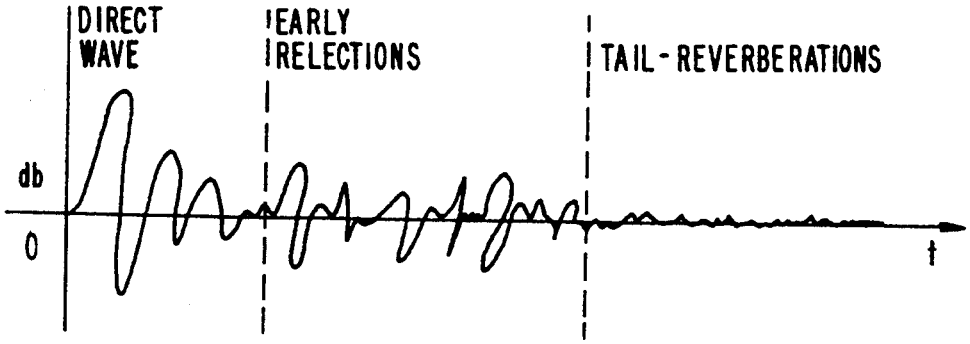
FIG. 1 is a representation of a sound wave received at one ear of a listener sitting in a room with the sound source being a single loudspeaker.

The present invention operates upon an audio signal in a fashion to recreate over headphones a signal that has been produced from a loudspeaker or transducer in a room containing the listener. In other words, an input audio signal is processed as if the signal were, in fact, being received at the ears of the listener residing in a room. The invention is based upon the realization that such a sound signal is basically divided into three portions. The first portion is the direct wave portion that represents the sound being directly received at the ear of the listener. FIG. 1 represents a typical sound wave produced by a loudspeaker in a room and received at the ear of a listener, and the direct wave portion is, of course, the first portion of such sound wave. The second portion is then made up of a number of early reflection portions that are of decreased amplitude based upon the amount of attenuation caused by the reflection path and represent the original signal being reflected from the walls, floor, and ceiling of the room containing the listener. The third portion is the final portion according to the present invention and represents the tail or so-called reverberations, which are the multiple reflections of the sound wave after having been bounced off the walls, floor, and ceiling a number of times so that the original direct wave has now been severely reduced in amplitude and is completely incoherent as to any directional information contained therein.

one approach to developing a transfer function representing a sound wave such as shown in FIG. 1 is shown in FIG. 2. Such transfer function will then provide the filter coefficients to be utilized in a digital filter, such as an FIR. In FIG. 2, a listener 10 is located within a room 12 and the dashed line 14 surrounding the listener represents the range of locations that are possible in creating an out-of-head sound source location. These locations and the transfer functions corresponding to different locations around the circle 14 form the so-called head filter. The filter coefficients of the head filter may be determined empirically for each ear 16, 18 of the listener 10 and for each location using the set up of FIG. 2. A loudspeaker 18 can be arranged within the room 12 and directed so that the sound produced reaches the ears 16, 18 over direct paths 20, 22 and also over reflected paths, two of which are shown at 24, 26, that are present when the sound is reflected by walls 28, 30, respectively of the room 12. By moving the speaker 18 to various locations around the listener 10 and detecting the signal waveforms using a microphone at the right ear 16 of the listener and then at the left ear 18 of the listener, a library of sound positions can be built up. Once the appropriate location patterns have been obtained then by following the present invention any input audio signal can be processed to simulate a sound source location corresponding to one of the patterns that has been determined. It has been determined that using a digital filter with approximately 6,000 taps that a signal such as shown in FIG. 1 and obtained using the set up of FIG. 2 can be simulated. Clearly, however, such a large filter is not practical for a commercially available system. Therefore, the present invention teaches a more economical system, such as shown in FIG. 3.

Figure 3:
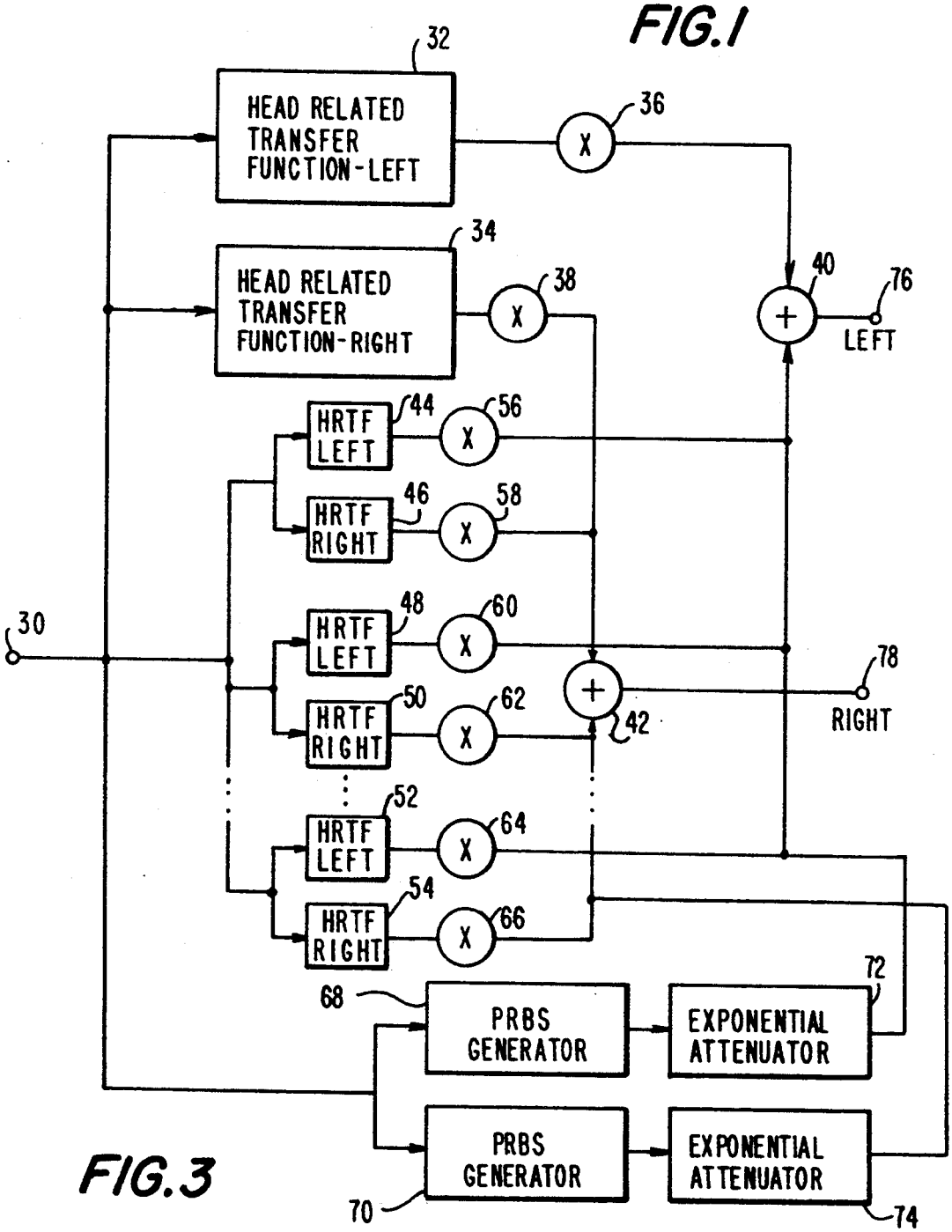
FIG. 3 is a schematic in block diagram form of a headphone processing system according to an embodiment of the present invention.

Referring to FIG. 3, an audio signal is fed in at terminal 30 and is fed directly to a left head-related transfer function device 32 and a right head-related transfer function device 34. This terminology is selected although these devices are, in fact, digital filters (FIRs). These filters provide transfer functions derived using the system of FIG. 2 that relate the direct wave portion of the sound signal as represented in FIG. 1. In place of the head-related transfer function filters frequency dependent phase and amplitude filters may be substituted. Although the direct wave portion of the head-related transfer function can be processed extensively, it has been determined that by utilizing a transfer function corresponding to a location directly in front of a listener, that is, at 12 o'clock and then adjusting the amplitude and delay corresponding to the indirect sides of the head-related transfer function, it is possible to achieve all azimuths over a 180° span using a single head-related transfer function filter.

Figures 4, 5:
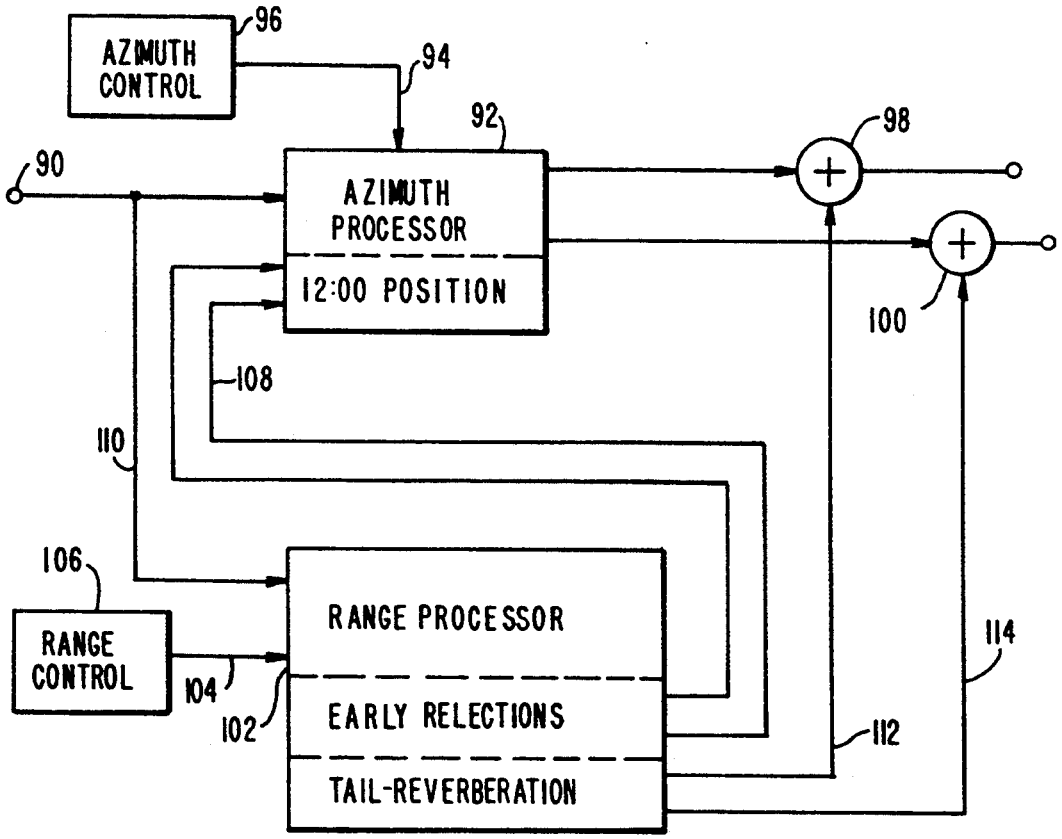
FIG. 4 is table of typical amplitude and delay values for various angles of sound placement.
FIG. 5 is a schematic in block diagram form of a headphone signal processor in which range control is provided according to an embodiment of the present invention.

FIG. 4 represents a table of values suitable for obtaining these results. The values at lines 1 and 2 represent the image at the right ear, as might be present between 12 o'clock and 3 o'clock, whereas the values at lines 4 and 5 represent the image at the left ear, as might be present between 12 o'clock and 9 o'clock.

Turning back to FIG. 3, the output of the two filters 32 and 34 are fed respectively through scalars 36 and 38. These scalars 36, 38 add a weighting factor that provides information as to the distance between the headphone listener and the apparent sound source. The scaled direct-wave left and right signals are then fed to adders 40 and 42 to be used in making up the left and right channel outputs. A number of filters representing the early reflections portion of the sound wave of FIG. 1 are also connected to receive the input signal fed in at input 30. Specifically, head-related transfer function filters 44, 46 form a left and right pair, as do head-related transfer function filters 48, 50 and 52, 54. These early reflection or secondary reflection filters can be substantially shorter than the direct-wave, head-related transfer function filters 32 and 34.

As will be shown in FIGS. 6A–6C, the present invention includes the realization that by using a so-called short head filter or sparse filter that it is possible to do time domain convolution and eliminate the use of long FIR filters that would typically employ a number of zero intermediate taps between the taps whereat the actual signals of interest reside.

The coefficients for filters 44 through 54 correspond to the early reflections shown in FIG. 1 that have been derived using a set-up such as shown in FIG. 2. As with the direct-wave filters, each of the early reflection filters includes a respective scalar in its output. Again, the scalars can provide a weighting function that imparts information concerning distance between the listener and the virtual sound source location. Specifically, the output of the filter 44 is fed through a scalar 56 to the left-channel adder 40. The output of the filter 46 is fed through a scalar 58 to the right-channel adder 42. The output of the filter 48 is fed through a scalar 60 to the left-channel adder 40 as is the output of the filter 52 fed through scalar 64. The early reflection filter 50 has its output fed through a scalar 62 as does the filter 54 through a scalar 66. Although three separate filter pairs are shown for processing the early reflections portion of the signal, as few as one pair may be used.

As seen from the tail portion of the sound waveform of FIG. 1, the reverberation portion is similar to white noise. Therefore, it is not necessary to provide a filter having specific filter coefficients but, rather, it is possible to use a pseudo-random binary sequence generator to produce random values that can then simulate these reverberation portions. Thus, the audio signal fed in at input terminal 30 is also fed to a pseudo-random binary sequence generator 68 for the left channel and to a pseudo-random binary sequence generator 70 for the right channel. In place of specific scalars, it is then possible to use exponential attenuators in the outputs so that the power in the audio signal waveforms simply dies down. Thus, the output of the pseudo-random binary sequence generator 68 is fed through an exponential attenuator 72 and added to the left-channel signal in adder 40, whereas the output of the pseudo-random binary sequence generator 70 is fed through exponential attenuator 74 whose output is then fed to the right-channel adder 42. Thus, the three portions of the waveform shown in FIG. 1 are appropriately filtered or simulated and all three portions are then combined in the channel adders 40 and 42, so that the left headphone channel is available at output 76 from the adder 40, whereas the right headphone channel is provided at terminal 78 as the output of the adder 42.

In the system of FIG. 3, the showing is for one particular azimuth and, indeed, one particular range, although it is understood, of course, that the scalars such as shown at 36, 38, and 56 through 66 are all variable so that different ranges are achievable. Similarly, it understood that the various head-related transfer function filters are filters that have their coefficients completely controllable such that different azimuths can be obtained, again based upon the data derived using a system such as shown in FIG. 2.

FIG. 5 shows the inventive system in somewhat less detail, but including the actual inputs for azimuth control and range control. In the embodiment of FIG. 5, an input audio sample is fed in through terminal 90 to an azimuth processor 92 that is essentially the embodiment of FIG. 3. That is, a system of head-related transfer function filters that generate the simulation of the signal waveform of FIG. 1. Also input to azimuth processor 92 is an azimuth control signal on line 94 fed from an azimuth control unit 96. This azimuth control unit 96 might be a joystick or other type of game device when this embodiment is used with a video game or it might consist of a panning pot or actual program material that contains a selected sequence of sound locations, that is, different azimuth angles for the locations of the virtual sound source. The azimuth control unit 96 provides the different coefficient values for the several filters making up the azimuth processor 92. The azimuth processor 92 produces the direct wave portions of the sound signal that are fed to appropriate signal adders, and the left channel is fed to adder 98 and the right channel to adder 100. The input sample at terminal 90 is also fed to a range processor 102 that can be thought of as consisting of the various scalars and the like shown in FIG. 3.

Thus, a range control signal is fed in on line 104 from a range control unit 106 that again includes some device that can be controlled by the user, in the case of the video game, or that can be controlled by a program, in the case of a predetermined sequence of ranges to be simulated. The range processor then may be seen to be performing the appropriate processing on the early reflections part of the audio signal and on the reverberation part of the audio signal, with the outputs corresponding to the early reflections being fed to the azimuth processor 92 and the outputs relating to the tail or reverberation portions being fed to adders 98 and 100 on lines 112 and 114, respectively.

As noted earlier, it is possible to accomplish a sound location over approximately 180° using only a single head-related transfer function filter by controlling the angles and amplitudes of the various samples using values shown in FIG. 4 and, for that reason, the azimuth processor 92 is represented as including a 12 o'clock position unit.

FIG. 6A represents a signal waveform such as shown in FIG. 1 and as noted can be simulated or processed using an FIR filter having approximately 5,000 taps. Thus, FIG. 6A represents a so-called dense FIR filter based on an actual room measurement. On the other hand, because as previously noted the early reflections are based upon the reflections of the sound from the walls, ceiling, and floor of the room these signals are less densely distributed and, thus, a filter to process that signal might be viewed as a sparse filter. As seen in FIG. 6B a series of spikes are present that represent initial early reflections and most of the data over the time of interest consists of zeros, with data points at only 100, 1110, 2100. Thus, if the input sample appears as shown in FIG. 6C, we need only look at the three data points shown at $T_1$, $T_2$, and $T_3$. This means that an entire filter need not used and a delay line can be used by looking at specific taps in the delay line. This permits the calculation of the left and right directionalized values, such as the values represented in FIG. 4.

Figure 7:
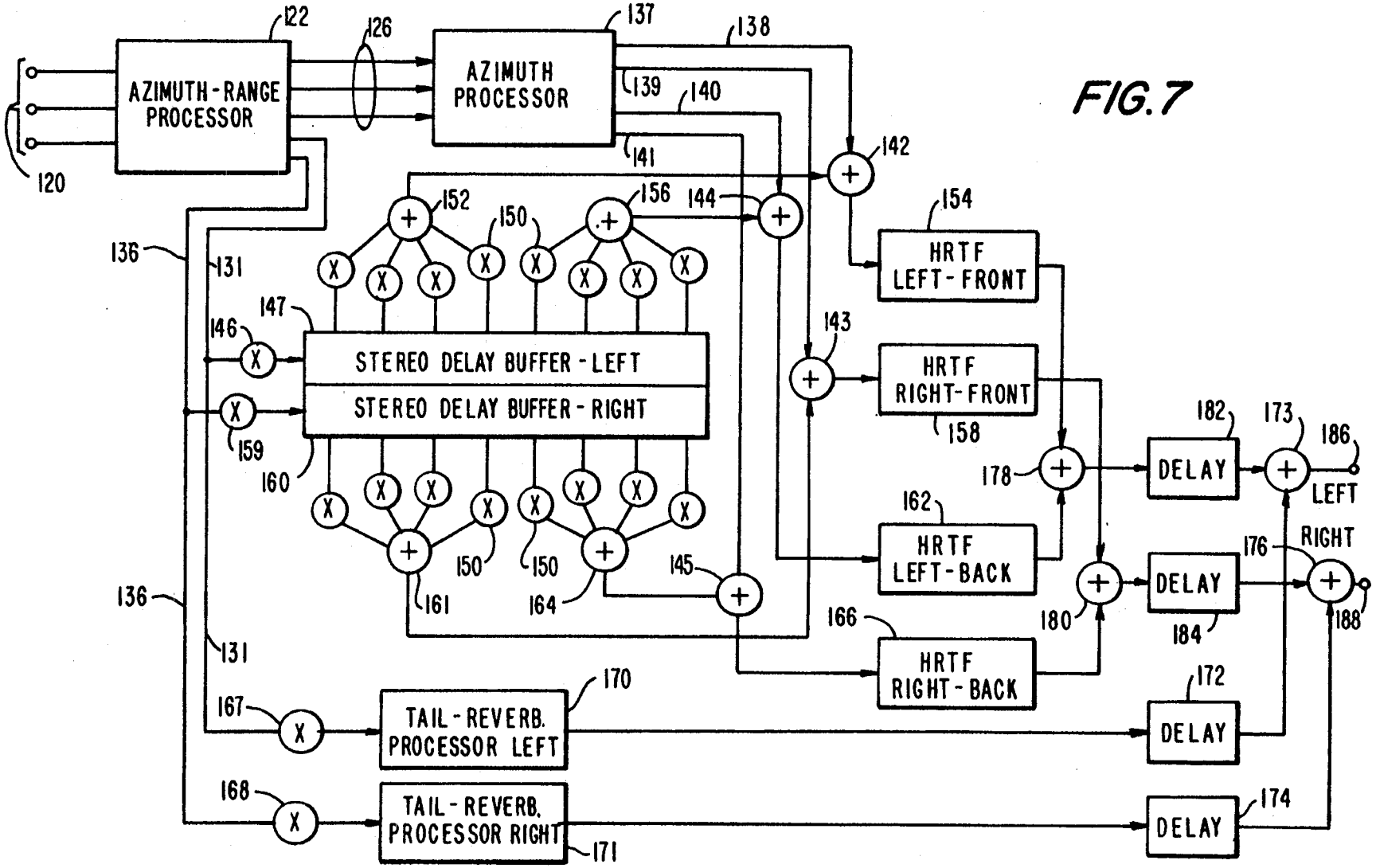
FIG. 7 is a schematic in block diagram form of a headphone signal processor employing range processing according to an embodiment of the present invention.
Figure 8:
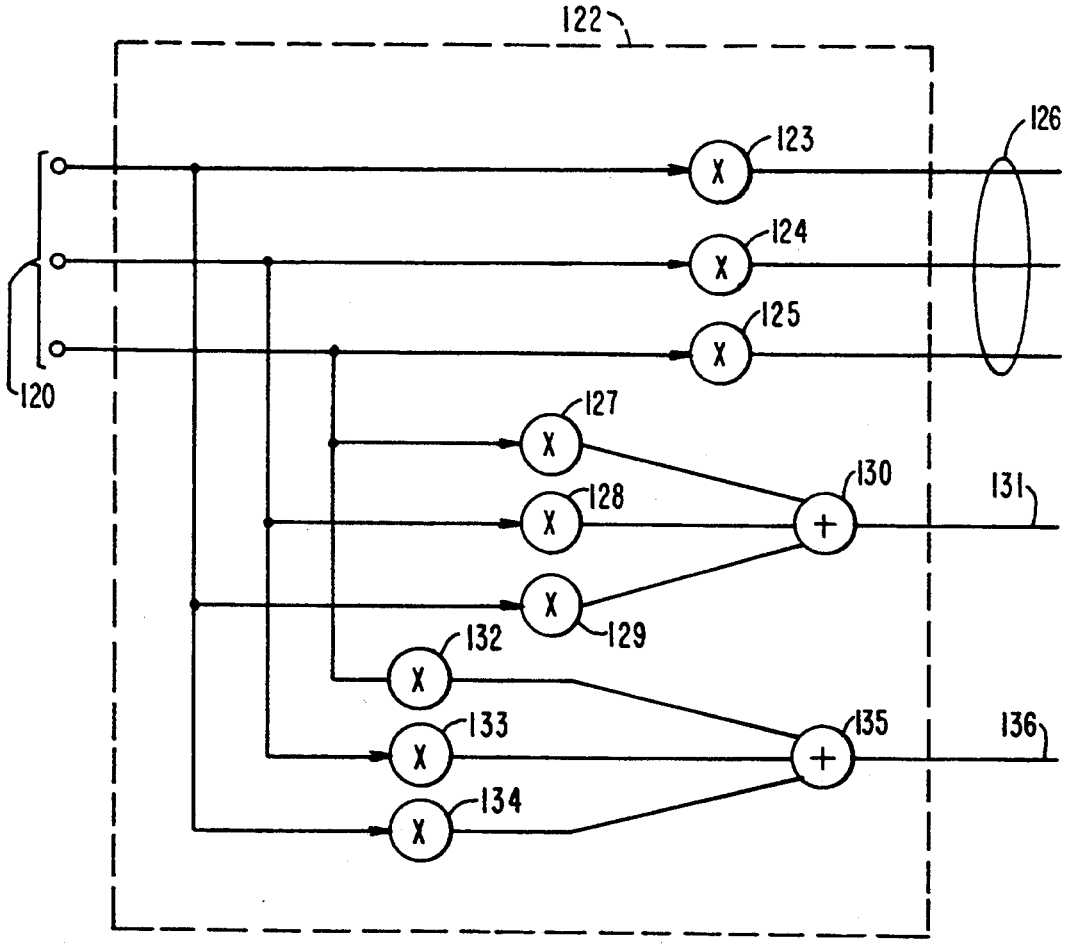
FIG. 8 is a schematic showing an element in the embodiment of FIG. 7 in more detail.

FIG. 7 represents a system using the sparse filter in which input samples are fed in at terminals 120 to an azimuth-range processor 122. As noted, the azimuth-range processor 122 provides scaling to the input samples that are intended to relate to the simulated distance between the listener and the sound source. The azimuth-range processor 122 is shown in more detail in FIG. 8, in which the inputs 120 are scaled and summed to form two reverberation channels. More specifically, the input samples 120 are amplitude adjusted in scalars 123, 124, 125 to add range information to the signals on lines 126 that are to be subsequently azimuth processed. The input samples 120 are also fed to scalars 127, 128, 129 to form amplitude adjusted signals that are combined in a signal adder 130 to form a left-channel range adjusted signal on line 131 that is to be subsequently early reflection and reverberation processed. Similarly, the input samples 120 are also fed to scalars 132, 133, 134 to form amplitude adjusted signals that are combined in a signal adder 135 to form a right-channel range adjusted signal on line 136 that is to be subsequently early reflection and reverberation processed.

Turning back to FIG. 7, the samples representing the direct wave portion, corresponding to the first segment in FIG. 1, are fed on lines 126 from the azimuth-range processor 122 to the azimuth processor 137. The azimuth processor 137 finds or identifies and applies numbers from the delay/amplitude table, such as shown in FIG. 4. The azimuth processor 137 then produces a front left signal on line 138, a front right signal on line 139, a back left signal on line 140, and a back right signal on line 141. The front left signal is fed on line 138 to an adder or signal summer 142 and the front right signal is fed on line 139 to a summer 143. Similarly, the back left signal is fed on line 140 to a summer 144 and the back right signal is fed on line 141 to another summer 145. Although the pairs of signals are referred to as front and back any other locations are also possible in keeping with the teaching of this invention.

The signal representing the early reflections and the tail or reverberation portions, that is, the latter two portions of the waveform of FIG. 1, for the left channel on line 131 is fed through a scalar 146 to a stereo delay buffer 147 representing the left channel. This stereo delay buffer 147 is just a long delay line that has two groups of taps corresponding to reflections for the front and back or for one or more other sound source locations. Each group represents approximately 85 taps. Each tap of the group is fed through a respective amplitude scalar, shown typically at 150, and the suitably scaled left early reflections for a first or front location are summed in a summer 152 and fed to adder 142. The output of adder 142 is then fed to a head-related transfer function filter 154 corresponding to the left side at the front location. Similarly, the left early reflections for the back or second location are summed in a summer 156 and the summed output fed to summer 144 whose output is fed to a head-related transfer function filter 162 corresponding to the left back position.

The right-channel signal on line 136 from the azimuth-range processor 122 is fed through a scalar 159 to a stereo delay buffer 160 representing the right channel, which buffer is identical to buffer 147. The output taps of the stereo delay buffer 160 corresponding to the right-side at the front or first location, after having been suitably scaled in scalars 150, are summed in a summer 161 whose output is fed to summer 143 and then fed to head-related transfer function filter 158 corresponding to the right side at the front location. The outputs of the delay buffer 160 corresponding to the right side at the back or second location, after having been suitably scaled in scalars 150, are added in summer 164 and the summed signal is then fed to adder 145. The summed output of adder 145 is fed to a head-related transfer function filter 166 corresponding to the right side at the back location.

So far we have developed a processing for the direct wave and for the early reflection waves and it remains to process the tail portion for combining with the other elements. The tail filters or reverberation processors from the left and right sides are fed with the signals on lines 131 and 136 after having been suitably scaled in scalars 167 and 168, respectively and then to a tail reverberation processor 170 for the left locations and to a tail reverberation processor 171 for the right locations. These filters 170, 171 may be relatively long FIR filters with fixed value coefficients or they may consist of the pseudo-random number generators such as shown in FIG. 3. The output of the reverberation processor 170 for the left positions is fed through a delay unit 172 to an adder 173, and the output of the reverberation processor 171 for the right positions is fed through a delay unit 174 to an adder 176. The delay units 172, 174 make sure that all signals arrive at the adders 173, 176 at the correct time.

The early reflections processing and the direct wave processing for the front location and the back location then combine and, specifically, the left channel is combined in an adder 178 and the right channel is combined in an adder 180. The output of adder 178 is fed to a delay line 182 and, similarly, the output of adder 180 is fed to delay line 184. These delay lines are provided, just as delay lines 172 and 174, to adjust the relative timings of the processing so that the waveforms can be suitably constructed as shown in FIG. 1. The output of delay line 182, representing the processed direct and early reflection waves for the left channel for front and back locations is fed to summer 178 where it is combined with the left tail or reverberation processed signal, which does not have front and back information and is available at the left output terminal 186. Similarly, the direct signal and early reflections for the right channel are fed out of delay unit 184 to summer 176 where they are combined with the processed reverberation portion for the right channel, which does not have front and back information, and is fed out on terminal 188.

Figure 9:
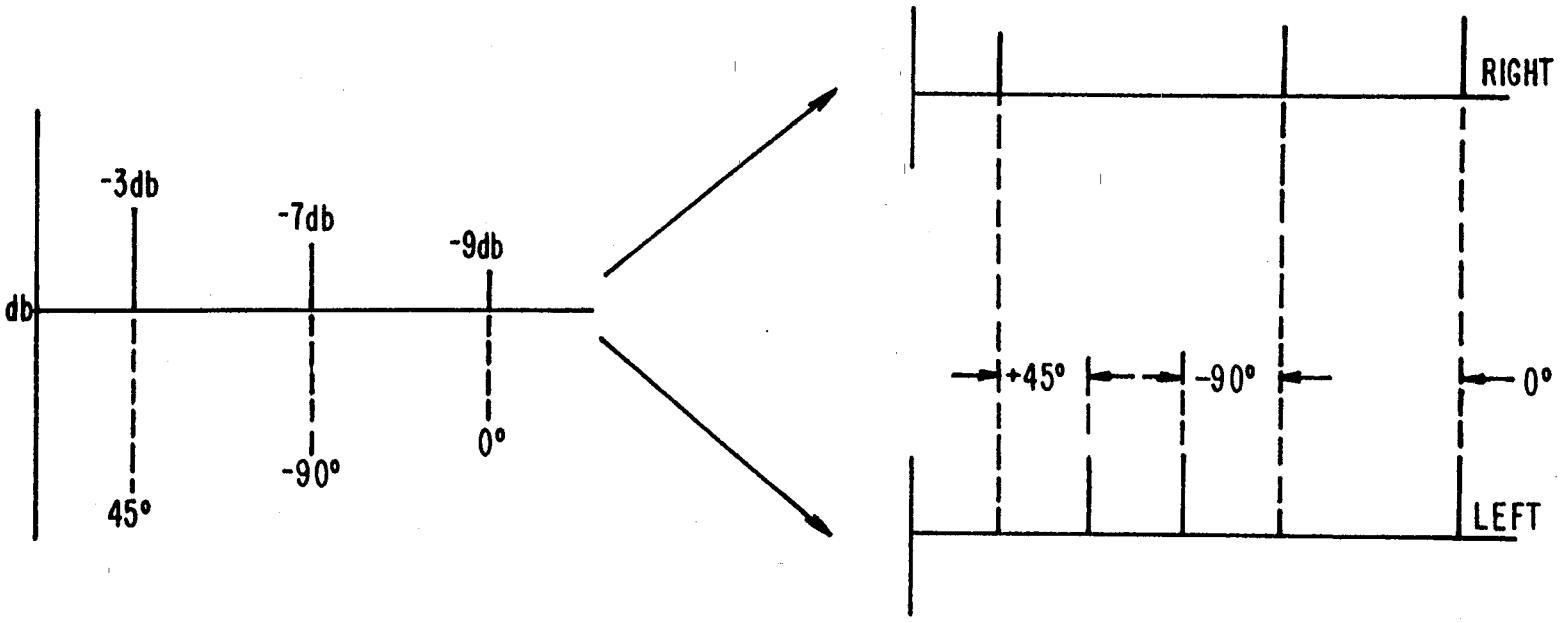
FIG. 9 shows the operation of an element used in the embodiment of FIG. 7 in more detail.

FIG. 9 represents the processing that takes place in each of the delay buffers 147 and 160 in the embodiment of FIG. 7 and shows how by suitably choosing the output taps, it is possible to produce the front and back signals for the left or right channel without doing two steps of processing. That is, the phase and amplitude values are represented on the abscissa with the appropriate amplitude and delay and then by separating into front and back signals, for example, it is shown that the differences between the two samples correspond to the original amplitude and delays of the single signal derived from the range processor. Note the amplitudes and delay values correspond to the table shown in FIG. 4.

Figure 10:
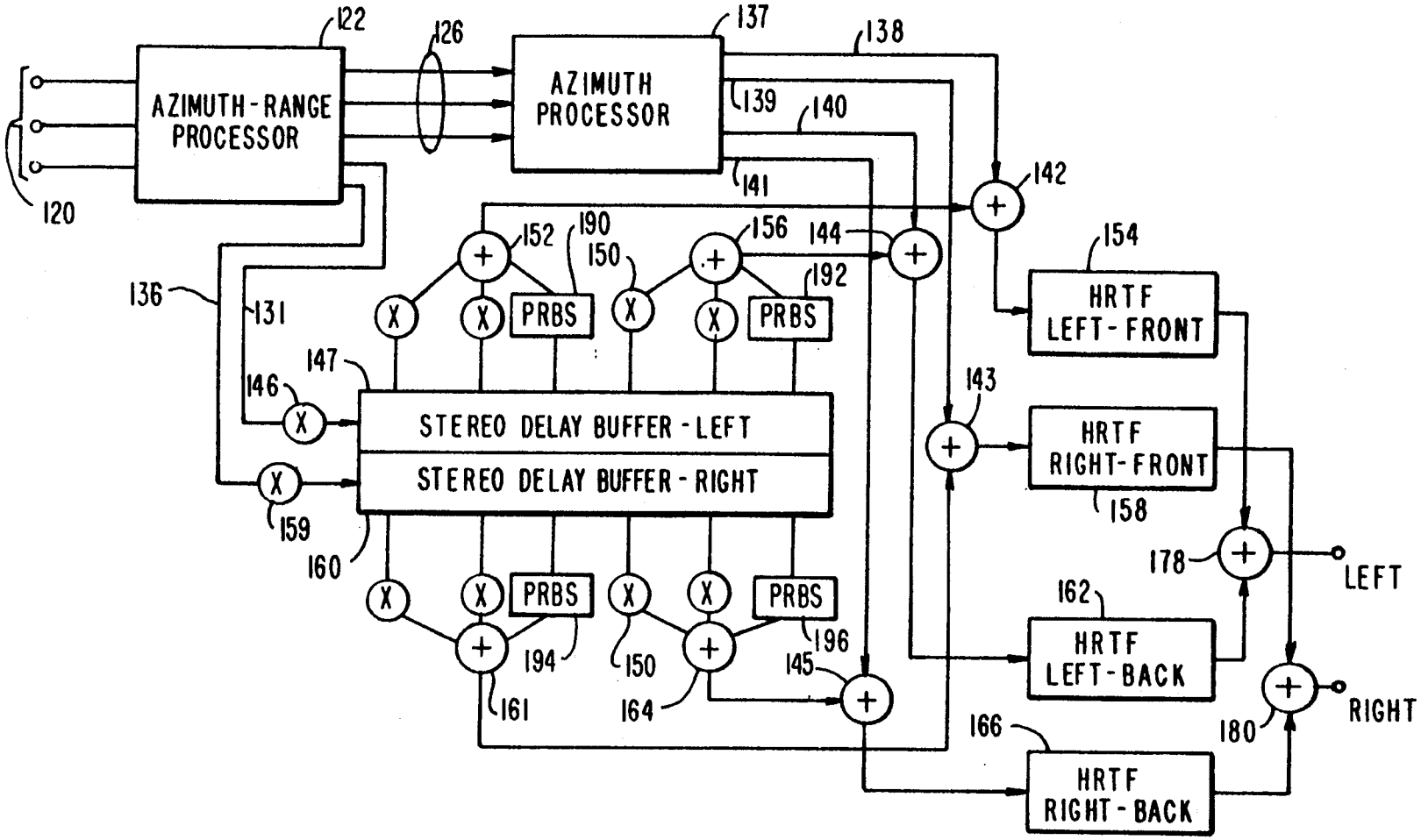
FIG. 10 is a schematic in block diagram form of a headphone signal processor employing range processing according to a second embodiment of the present invention.

FIG. 10 shows another embodiment of the present invention in which the tail reverb processor is eliminated and, instead, the corresponding output taps from the stereo delay buffers are processed through a pseudo-random binary sequence generator to produce signal components corresponding to those late reflection or tail portions. Specifically, outputs from the stereo delay buffer 147 representing the left side and specifically representing the front left side are passed through a pseudo-random binary sequence generator 190 and are summed in summer 152 and processed in the same fashion as in the embodiment of FIG. 7. Similarly, the output taps from the stereo delay buffer 147 corresponding to the left rear are passed through a pseudo-random binary sequence generator 192 and summed in summer 156. In the right channel, the outputs from the stereo delay buffer 160 are passed through a pseudo-random binary sequence generator 194 and summed in summer 161 and the right tail components corresponding to the rear are output from the stereo delay buffer 160 and fed through a pseudo-random binary sequence generator 196 where they are summed in summer 164. The outputs of summers 152, 156, 161, and 164 are processed in the same fashion as described in relation to the embodiment of FIG. 7. Because the tail-reverb processor is not employed in this situation, the additional delays and summers at the output of the embodiment of FIG. 7 are not required. Optionally, if a heavy reverberation were desired, the embodiment of FIG. 7 could be employed with the additional pseudo-random binary sequence generators of the embodiment of FIG. 10 added therein.

Figure 11:
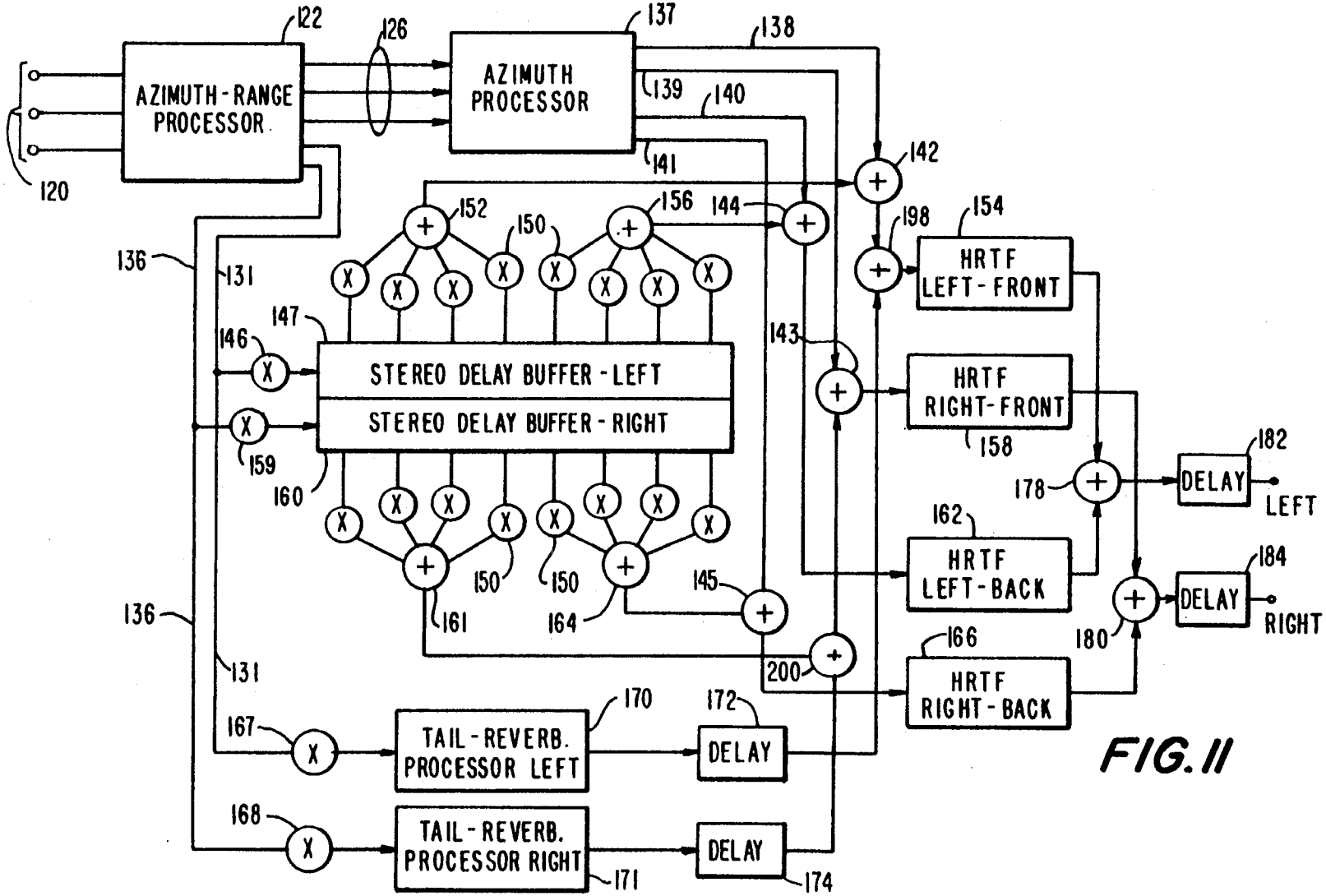
FIG. 11 is a schematic in block diagram form of a headphone signal processor according to a third embodiment of the present invention.

FIG. 11 shows still a further embodiment of the present invention in which directionality is added to the reverberation signal by taking the outputs of the tail reverberation processors 170 and 171 and adding them to the direct and early reflection signals before being passed through the head related transfer function processors. Specifically, the outputs of delay 172 corresponding to the tail reverberation for the left side is added in adder 198 to the output of adder 142 which represents the left front signal before being fed to the head related transfer function processor 154. On the other hand, the reverberation processing for the right channel, as output from delay unit 174, is fed to adder 200 where it is added with the output of the right front portion from delay buffer 160 with the summed signal then being fed to adder 143 whose output is fed to the head related transfer function processor for the right component. Thus, it is seen that this will provide directional processing to the reverberation signal along with the other two signal portions, as shown in FIG. 1.

The above description is based on preferred embodiments of the present invention, however, it will be apparent that modifications and variations thereof could be effected by one with skill in the art without departing from the spirit or scope of the invention, which is to be determined by the following claims.

What is claimed is:

1. Apparatus for processing an input audio signal for playback over headphones in which an apparent source of the audio signal is located outside the head of the headphone user, comprising:

left and right head related transfer function filters, each receiving the input audio signal and producing a respective output signal, said left and right filters having predetermined coefficients based on a selected azimuth of the apparent source of the audio signal relative to the headphone user;

a plurality of pairs of left and right filters each receiving the input audio signal and producing a respective output signal, said plurality of left and right filters having predetermined coefficients based on amplitude attenuated and time delayed portions of the input audio signal;

left and right pseudo-random signal generators each receiving the input audio signal and producing a respective output representing a delayed pseudo-random sequence of the input audio signal; and left and right signal summing means respectively receiving the outputs of said left and right head-related transfer function filters for summing with the respective outputs of said plurality of pairs of left and right filters and for summing with the respective outputs of said left and right pseudo-random signal generators to produce left and right summed output signals fed to left ear and right ear transducers of the headphones.

2. The apparatus according to claim 1, further comprising a plurality of amplitude scalars connected respectively to the outputs of said left and right head-related transfer function filters and said plurality of left and right filters for adjusting amplitudes of the outputs for imparting information relating to a range between the headphone user and the apparent source of the audio signal.

3. The apparatus according to claim 2, further comprising left and right exponential attenuators connected respectively to the outputs of said left and right pseudo-random signal generators for exponentially decreasing amplitudes of the outputs over time to impart further information relating to the range between the headphone user and the apparent source of the audio signal.

4. Apparatus for processing an input audio signal for playback over headphones in which an apparent source of the audio signal is located outside the head of the headphone user, comprising:

azimuth processor means receiving the input audio signal and producing left and right processed output signals, said azimuth processor means including left and right filters having coefficients based on an azimuth angle of the apparent source of the audio signal relative to the headphone user;

azimuth control means for producing a control signal fed to said azimuth processor means for controlling the azimuth angle in response to azimuth information contained therein;

range processor means receiving the input signal and producing left and right processed output signals that are attenuated in amplitude to represent a range between the apparent source of the audio signal and the headphone user;

range control means for producing a control signal fed to said range processor means for controlling an amount of the amplitude attenuation in response to range information contained therein; and left and right signal summing means connected to sum the respective outputs from said azimuth processor means and said range processor means and produce left and right summed output signals fed to respective left and right ear transducers of the headphones.

5. Apparatus for processing input audio signals for playback over headphones in which an apparent source of the audio signal is located outside of the head of the headphone user, comprising:

range processor means receiving the input audio signals and producing outputs therefrom that are attenuated in amplitude to represent a selected range between the location of the apparent sound source and the headphone user;

azimuth processor means receiving outputs from said range processor means and producing a first plurality of outputs therefrom having information imparted thereto relating to a selected azimuth angle between the apparatus location of the audio signal and the headphone user;

delay buffer means receiving as an input signal an output from said range processor means for producing at a plurality of outputs the input signal having been delayed in time and attenuated in amplitude, said delay buffer means including a plurality of signal adders each for adding selected outputs of said delay buffer means and producing a plurality of outputs equal in number to said first plurality of outputs from said azimuth processor means;

reverberation processor means receiving as in input signal the output from said range processor means fed to said delay buffer means for producing left and right reverberation outputs therefrom;

a plurality of head-related transfer function filters respectively receiving said first plurality of outputs from said azimuth processor means and outputs from said plurality of signal adders in said delay buffer means and in which filter coefficients are set by said information relating to the selected azimuth angle;

signal summing means receiving outputs from said plurality of head-related transfer function filters and said from said reverberation processor means for producing left and right summed signals fed respectively to left and right ear transducers of the headphones.

6. The apparatus of claim 5, wherein said signal summing means comprises:

a first pair of left and right signal summers connected respectively to left and right pairs of said plurality of head-related transfer function filters and producing a left and a right output therefrom; and a second pair of left and right signal summers connected respectively to the left and right outputs of said first pair of signal summers and to said left and right reverberation outputs and producing therefrom said left and right summed signals.

7. The apparatus according to claim 6, wherein said signal summing means further comprises first and second time delay means connected respectively between said first pair of signal summers and said second pair of signal summers.

8. The apparatus according to claim 5, wherein said delay buffer means includes four sets of plural output taps representing different time delayed versions of the signal input thereto and in which an amplitude scalar is connected in each output tap and in which one of said plurality of adders is connected to sum the respective sets of output taps.

* * * * *